US005584132A

United States Patent [19]

Weaver et al.

[11] Patent Number: 5,584,132

[45] Date of Patent: Dec. 17, 1996

[54] SHOELACE TIP HOLDER

[76] Inventors: Henry Weaver; Brent Weaver, both of 1727 W. 180th St., Gardena, Calif. 90248; Ronald Perryman, 3843 Bluff St., Torrance, Calif. 90505

[21] Appl. No.: 254,609

[22] Filed: Jun. 6, 1994

[51] Int. Cl.[6] ..... A43B 23/00; A43C 9/04

[52] U.S. Cl. ..... 36/136; 36/1; 36/50.1; 24/715.4; 24/715.6

[58] Field of Search ..... 36/1, 112, 132, 36/136, 50.1; 24/715.4, 715.5, 715.6, 715.7, 712.4, 712.9, 713.1, 713.6; 206/306

[56] References Cited

U.S. PATENT DOCUMENTS

| | | | |
|---|---|---|---|
| 658,998 | 10/1900 | Randall | 206/306 |
| 1,919,811 | 7/1933 | Stonebreaker | 206/306 |
| 2,931,893 | 4/1960 | Arias et al. | 36/137 |
| 2,961,727 | 11/1960 | Coffey | 24/715.6 |
| 3,338,390 | 8/1967 | Gordon | 206/306 |

*Primary Examiner*—Marie D. Patterson
*Attorney, Agent, or Firm*—Charles H. Thomas

[57] ABSTRACT

An adapter is provided for attaching decorative articles to shoelace tips. The adapter is small and inconspicuous with an outer cylindrical shape only about one inch in length and one quarter of an inch in outer diameter. The adapter has at one end a fitting for releasable securement to a decorative article, such as a light stick. At its opposite end the adapter is hollow and defines therewithin a plurality of coaxial sockets of decreasing diameter proceeding from the shoelace attachment end toward the decorative article receiving end. Each of the sockets preferably has a plurality of radially inwardly directed ribs that aids in frictionally engaging the stiffened tip of a shoelace within a socket of corresponding size. The adapter may be attached to the stiffened plastic tips of shoelaces to fasten decorative articles, such as light sticks to the shoes of a wearer.

16 Claims, 1 Drawing Sheet

SHOELACE TIP HOLDER

BACKGROUND OF THE INVENTION

1. Field of the Invention

The present invention relates to an adapter designed for attachment to the rigid tip of a shoelace and which is configured for releasable securement to a decorative article.

2. Description of the Prior Art

Various devices have been proposed for attachment to the tips of shoelaces for securing decorative articles thereto. For example, one such device is depicted in U.S. Pat. No. 2,961,727. However, all of the conventional systems for securing decorative articles to shoelaces have been excessively complex, inordinately bulky, or both.

SUMMARY OF THE INVENTION

The invention involves an attachment device for connection to the ends of shoelaces so as to allow decorative articles to be affixed to the shoelace ends. For example, light sticks may be attached to shoelace ends using the connector device of the invention. In addition, other novelty items, such as small cartoon figures, tassels, small decorative articles, and other ornamental objects may be attached to the shoelace ends using the connector device.

The connector or adapter device of the invention is a tubular structure having a series of stepped down cylindrical cavities or channels defined therewithin. The series of step down cavities is formed so that the cavities serve as a plurality of sockets to accommodate the various different sizes of hardened shoelace ends that are used most widely on a commercial basis. Thus, the connector device of the invention may be utilized on virtually any type of shoelace that is commercially available.

As viewed from the end of the device, the stepped down series of passageways appears as a series of concentric rings. Preferably the interior walls of the sockets defined by the openings are provided with a plurality of circumferentially spaced, radially inwardly projecting ribs designed to exert a pinching effect on a shoelace end inserted into the sockets. The end of the connector device opposite the shoelace tip attachment end forms a fitting adapted to receive a decorative article, for example a cylindrical tube containing a chemical that glows in the dark. Alternatively, other decorative articles may have stems that can be inserted into the socket.

To utilize the connector device of the invention, the user merely seizes the stiffened plastic tip of a shoelace end and inserts it into the shoelace attachment end of the connector device. The shoelace tip will enter the connector device, passing through successively narrower cavities until it reaches the cavity into which it snugly fits. At this point the shoelace tip is secured by frictional force within the connector device. If radially inwardly projecting ribs are employed, the range of tolerance of manufacturing variations in the shoelace tips that will be snugly received within the sockets is enhanced.

The present invention is directed toward an adapter that is extremely simple in construction, quite compact and visually inconspicuous, yet which is highly effective in securing the stiffened tip of a conventional shoelace to a decorative article. The adapter thus provides a simple, economical means for connecting a decorative article to a shoelace tip.

The shoelace tip adapter of the invention is extremely versatile. The great majority of commercially available shoelaces are manufactured with stiffened tips formed of plastic and configured in a generally cylindrical shape. The tips of most commercially available shoelaces are manufactured in only a few different diameters, since the shoelace tips must pass through shoe eyelets or grommets which likewise are manufactured in a relatively small number of standard sizes. A very distinct advantage of the adapter of the present invention is that it can be utilized with virtually any of the shoelaces which enjoy widespread commercial use. This versatility exists because each adapter is provided with a plurality of coaxial sockets of decreasing diameter proceeding from the shoelace receiving end toward the decorative article receiving end. These sockets are formed of particular diameters, each configured to receive a particular standard size of shoelace tip.

The tips of the shoelaces are received within the adapter of the invention and held there by frictional engagement. To enhance the versatility of use, the shoelace tip receiving sockets of the adapter of the invention are each preferably provided with a plurality of longitudinal ridges or ribs that extend lengthwise along the inside surfaces of the sockets and project radially inwardly into the socket cavities a short distance. Preferably, the ridges extend inwardly between about 0.002 and about 0.004 inches. The use of radially inwardly directed ridges in the sockets allows the sockets to receive shoelace tips manufactured within wider manufacturing tolerances than sockets which are not equipped with such ridges or ribs.

One principal application of the adapter of the invention is for use in securings light sticks to shoelace tips. Such glow tubes are commercially available in the form of narrow cylinders about 40 millimeters in length and about 4.5 millimeters in diameter. These light sticks contain a chemi-luminescent substance. When activated, the chemi-luminescent substance emits light visible for a number of hours. Such light sticks are commercially available from several different sources, one of which is Omniglow Corporation located in Novato, Calif.

While one primary application of the invention is to serve as a means for attaching light sticks to the stiffened tips of shoelaces, the invention is not limited in this regard. Indeed, the novelty device receiving end of the adapter of the invention can be configured in different ways to receive and releasably attach to many different kinds of small decorative devices with which a user may wish to adorn the tips of shoelaces.

In one broad aspect the present invention can be considered to be an adapter for attaching decorative articles to a shoelace tip comprising a stiff structure having opposite ends with a fitting at one end for releasable securement to a decorative article and having at its other end a plurality of coaxially aligned sockets of decreasing areas of cross section proceeding away from the other end and toward the end first mentioned. Each of the sockets is formed with a cross sectional area to snugly receive commercially available shoelace tips of corresponding size.

Preferably, the sockets are of a generally cylindrical cross section having ribs that extend radially inwardly from the socket walls. The sockets preferably include sockets having nominal diameters of 0.120 inches, 0.105 inches and 0.090 inches. These diameters should have a manufacturing tolerance of plus or minus 0.002 inches. The ribs preferably extend radially inwardly from the socket walls a distance of between about 0.002 and about 0.004 inches. An adapter configured in this manner will snugly receive within one of its sockets the tips of the vast majority of commercially available shoelaces.

In another broad aspect the invention may be considered to be the combination of a shoelace having stiffened tips at its extremities, an adapter equipped with a hollow shoelace attachment end into which a succession of coaxially aligned sockets are formed, wherein the sockets successively decrease in diameter with increasing distance from the shoelace attachment end, and wherein the adapter also has a decorative fastening end with a fitting thereon. The combination also includes a decorative article small enough for attachment to a shoelace tip and having a fitting thereon that mates with and is receivably attached to the fitting on the adapter. One of the stiffened tips of the shoelace is inserted into and held by friction within one of the sockets in the adapter of corresponding size.

In still another broad aspect the invention may be considered to be the combination of a shoe having eyelets, a flexible shoelace having stiffened tips at the ends thereof laced through the eyelets, a decorative article of a size suitable for attachment to the shoelace tips, and an adapter joining the decorative article to one of the shoelace tips. The adapter has opposite first and second ends wherein the first end is configured to securely receive the decorative article and the second end is hollow and defines therewithin a plurality of coaxial sockets of decreasing diameter proceeding away from the second end toward the first end. Each of the sockets has a diameter that is sized to receive different sizes of shoelace tips of different commercially available shoelaces. One of the tips of the shoelace that is laced through the eyelets is frictionally engaged in one of the sockets of corresponding size.

The invention may be described with greater clarity and particularity with reference to the accompanying drawings.

DESCRIPTION OF THE EMBODIMENTS

Figure 1:
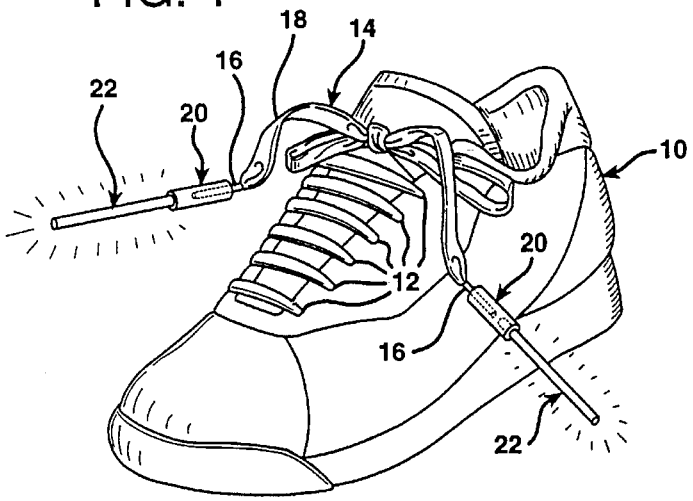
FIG. 1 is a perspective view illustrating one embodiment of a combination according to the invention.

FIG. 1 illustrates a conventional shoe 10 of the type which enjoys widespread commercial success and which is known in the trade as a "sneaker". The shoe 10 has a plurality of eyelets 12. A flexible cloth shoelace 14 has stiffened tips 16 at its ends and is laced through the eyelets 12. The shoelace 14 is typically formed of an elongated band of woven fabric 18, such as cotton, which may vary in length between about 21 and 44 inches, depending upon the number of eyelets 12 in the shoe 10. The end extremities of the cotton band 18 are crimped into and encased within the stiffened plastic shoelace tips 16, which typically vary in length between about three eighths of an inch and three quarters of an inch. The stiffened shoelace tips 16 typically have nominal outer diameters of about 0.087, 0.102 and 0.117 inches.

Figure 2:
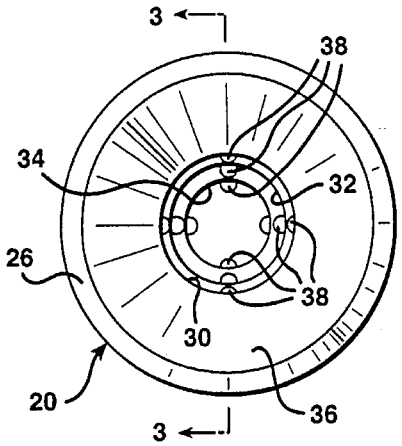
FIG. 2 is an enlarged end view of the shoelace receiving end of the adapter shown in FIG. 1.
Figure 3:
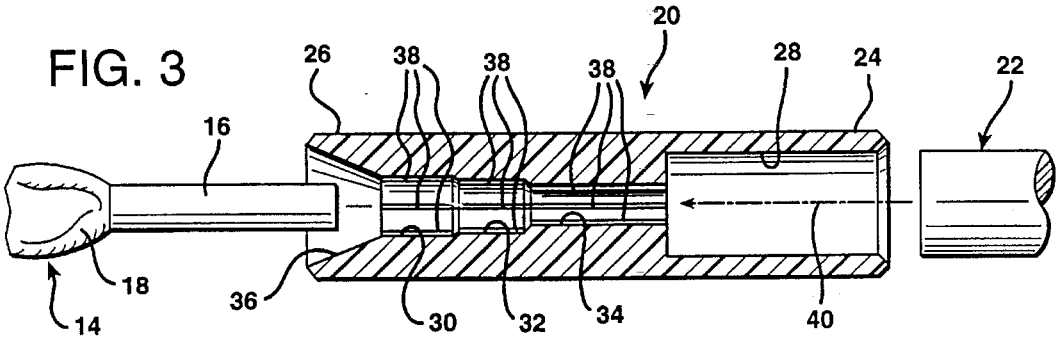
FIG. 3 is a sectional elevational view taken along the lines 3—3 of FIG. 2.

The shoelace tips 16 are each received within adapters or holders 20 constructed according to the invention. The holders 20 also receive decorative articles, which in the embodiment of FIGS. 1–3 are light sticks 22. The light sticks 22 are elongated cylinders 40 millimeters in length and 4.5 millimeters in diameter of the type previously described.

FIGS. 2 and 3 illustrate the adapter 20 in detail. As shown in those drawing figures, each adapter 20 has a first end 24 and an opposite second end 26. Each adapter 20 is formed as a unitary, stiff plastic structure about one inch in length and about one quarter of an inch in outer diameter. At its first end 24 each adapter 20 is formed with a cylindrical fitting shaped as a well or open ended cylindrical chamber 28 for receiving either end of a cylindrical light stick 22 therewithin in frictional engagement therewith. The opening into the chamber 28 is chamfered slightly at the first end 24 to facilitate insertion of the light stick 22 therein. The light stick receiving chamber 28 is preferably 0.160 inches in diameter at its inner wall surface.

At the second, opposite end 26 the adapter 20 is formed with a succession of coaxially aligned cavities that form sockets 30, 32 and 34 which successively decrease in diameter with increasing distance from the shoelace attachment end 26. The mouth opening in the shoelace attachment end 26 leading to the sockets 30, 32 and 34 has a frustoconical configuration, indicated at 36 so as to guide the shoelace tip 16 toward the common axis of alignment of the sockets 30, 32 and 34. At their extremities remote from the shoelace receiving end 26 the first two sockets 30 and 32 neck down slightly to form a frustoconical, guiding transition to the next successive socket. The nominal diameters of the sockets 30, 32 and 34 are 0.120 inches, 0.105 inches, and 0.090 inches, respectively. The diameters of all of the sockets 30, 32 and 34 are formed with a tolerance of plus or minus 0.002 inches.

Each of the generally cylindrical sockets 30, 32 and 34 is provided with four longitudinal ribs 38, each of which extends radially inwardly from the otherwise cylindrical socket walls a radial distance of between about 0.002 and about 0.004 inches. The ribs 38 within each of the sockets 30, 32 and 34 are located ninety degrees apart around the cylindrical interior socket wall from which they project radially inwardly. The ribs 38 that extend lengthwise along the sockets 30, 32 and 34 aid in immobilizing the tips 16 of the shoelace 14 therewithin.

In the embodiment of FIGS. 1–3, the fitting 28 at the first or decorative article receiving end 24 of the adapter 20 snugly receives an end of the light stick 22 in frictional engagement therewith. The light stick 22 is inserted into the end 24 as indicated by the directional arrow 40 in FIG. 3. The light stick 22 is thereby releasably, but securely held within the socket fitting 28 at the decorative article receiving end 24 of the adapter 20.

The opposite or shoelace tip receiving end 26 of the adapter 20 receives the stiffened shoelace tip 16 in a similar fashion in secure, but releasable frictional engagement within one of the sockets 30, 32 and 34. In the embodiment illustrated in FIG. 3, the shoelace tip 16 will fit snugly within the middle socket 32. The ribs 38 projecting radially inwardly from the walls of the socket 32 aid in frictionally gripping the exterior surface of the shoelace tip 16 so as to lodge it firmly within the socket 32 tightly enough so that the adapter 20 will not fall off of the shoelace tip 16 during normal use. Nevertheless, when one desires to remove the adapter 20, the shoelace fabric 18 can be gripped and pulled in the direction indicated by the directional arrow 40 from the end 26 of the adapter 20. A modest but firm longitudinal tensile force of no less than about five pounds acting between the shoelace 14 and the adapter 20 will be sufficient to overcome the frictional engagement of the shoelace tip 16 within the socket 32 so that the shoelace tip 16 can be longitudinally withdrawn therefrom.

Figure 4:
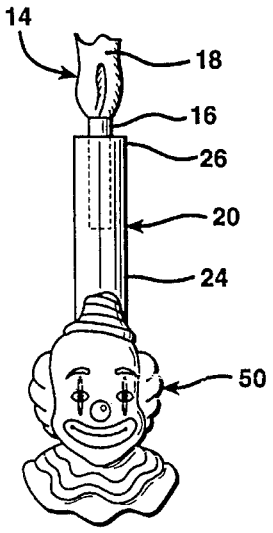
FIG. 4 illustrates the adapter of FIGS. 1–3 in combination with an alternative decorative article.
Figure 5:
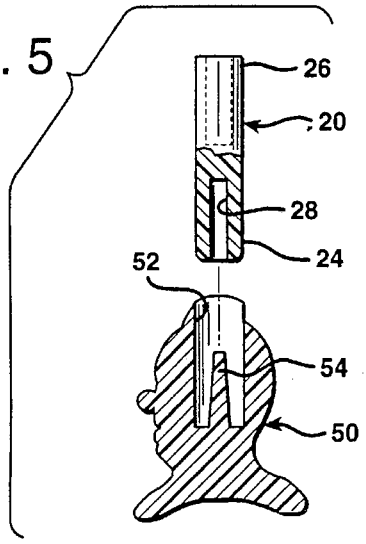
FIG. 5 is a side elevational view of the adapter and decorative article of FIG. 4, shown in exploded form and partially in section.

In the embodiment of FIGS. 1–3 the decorative article is a chemi-luminescent tube 22 that glows in the dark. However, the adapter of the invention may be utilized to carry other decorative articles on the shoelace tips 16. For example, as illustrated in FIGS. 4 and 5, the configuration of the adapter 20 is such that the decorative article receiving fitting socket 28 can be coupled to a small, plastic decorative article 50 shaped as the head of a clown. Within the clown head 50 there is a vertically aligned socket 52, from the base of which a coaxial pin 54 projects upwardly within the socket 52. The pin 54 is configured to have a nominal diameter of about 0.158 inches. Thus, the pin 54 will fit snugly into the decorative article receiving socket 28 in the end 26 of the adapter 20. FIGS. 4 and 5 illustrate that the use of the adapter 20 of the invention is not limited to light sticks 22, but may be utilized with numerous different small decorative articles of a size suitable for attachment to one of the shoelace tips 16.

Undoubtedly, numerous variations and modifications of the invention will become readily apparent to those familiar with shoelaces and footwear construction as well as those familiar with decorative articles designed for personal wear. For example, the end 24 of the adapter 20 can be configured with different sizes and shapes of fittings to accommodate different decorative articles. Accordingly, the scope of the invention should not be construed as limited to the specific embodiments depicted and described, but rather as defined in the claims appended hereto.

We claim:

1. In combination, a shoelace having stiffened cylindrical tips at its extremities, an adapter equipped with a hollow shoelace attachment end into which a succession of coaxially aligned sockets are formed wherein said sockets are each cylindrical in configuration and successively decrease in diameter with increasing distance from said shoelace attachment end and correspond in diameter with different sizes of commercially available shoelace tips, and wherein said adapter also has a decoration fastening end with a fitting on said decoration fastening end, and a decorative article small enough for attachment to a shoelace tip and having a fitting on said decorative article that mates with and is releasably attached to said fitting on said decoration fastening end of said adapter, and wherein one of said stiffened tips of said shoelace is inserted into and held by friction within a one of said sockets that is of a diameter corresponding to the size of said one of said stiffened tips.

2. A combination according to claim 1 wherein said adapter has a cylindrical outer configuration.

3. A combination according to claim 1 wherein said adapter defines ribs extending radially inwardly and extending lengthwise along said sockets to aid in immobilizing said tips of said shoelace therewithin.

4. A combination according to claim 3 wherein said ribs extend radially inwardly a distance of between about 0.002 and about 0.004 inches.

5. A combination according to claim 1 wherein said sockets include sockets having diameters of about 0.120 inches, about 0.105 inches and about 0.090 inches.

6. A combination according to claim 1 wherein said decorative article is a light stick containing a luminescent chemical that glows in the dark.

7. A combination according to claim 6 wherein said fitting is comprised of a cylindrical opening about 0.160 inches in diameter.

8. In combination, a shoe having eyelets, a flexible shoelace having opposite shoelace ends and stiffened, cylindrical tips at said shoelace ends wherein said shoelace is laced through said eyelets, a decorative article of a size suitable for attachment to said stiffened tips at said shoelace ends, and an adapter joining said decorative article to one of said shoelace tips and having opposite first and second adapter ends wherein said first adapter end is configured to securely receive said decorative article and said second adapter end is hollow and defines therewithin a plurality of coaxial, cylindrical sockets of decreasing diameter proceeding from said second adapter end toward said first adapter end, each of said sockets corresponding in size to a different size selected from among commercially available shoelace end sizes, and wherein one of said tips of said shoelace that is laced through said eyelets is frictionally engaged in one of said sockets of a size corresponding to one of said commercially available shoelace end sizes.

9. A combination according to claim 8 wherein said adapter is a unitary structure formed of plastic.

10. A combination according to claim 8 wherein said sockets are cylindrical and include sockets having cross sections of diameters of about 0.120 inches, about 0.105 inches and about 0.090 inches, each having a plurality of longitudinal ribs defined therewithin wherein said ribs each extend radially inwardly a distance of between about 0.002 and about 0.004 inches.

11. A combination according to claim 8 wherein said sockets are all provided with longitudinally extending radially inwardly directed ribs to aid in holding shoelace tips therewithin.

12. A combination according to claim 11 wherein said ribs extend radially inwardly a distance of between about 0.002 and about 0.004 inches.

13. A combination according to claim 12 wherein said coaxial sockets include sockets having diameters of about 0.120 inches, about 0.105 inches and about 0.090 inches.

14. A combination according to claim 8 wherein said decorative article is a light stick containing a luminescent chemical that emits electromagnetic radiation in the visible range for a number of hours.

15. A combination according to claim 14 wherein said first end of said adapter defines a socket therein having a diameter of about 0.160 inches that fictionally engages said light stick.

16. A combination according to claim 8 in which said adapter is configured with an outer cylindrical shape.

* * * * *